US005233765A

United States Patent [19]

Schaarschmidt

[11] Patent Number: 5,233,765

[45] Date of Patent: Aug. 10, 1993

[54] PROCESS FOR THE REGENERATION OF USED FOUNDRY SANDS

[75] Inventor: Ekart Schaarschmidt, Alfeld/Leine, Fed. Rep. of Germany

[73] Assignee: Kunkel-Wagner GmbH & Co. KG, Alfeld/Leine, Fed. Rep. of Germany

[21] Appl. No.: 698,719

[22] Filed: May 10, 1991

[30] Foreign Application Priority Data

Jun. 28, 1990 [DE] Fed. Rep. of Germany ..... 4020576
Jan. 10, 1991 [DE] Fed. Rep. of Germany ..... 4100520

[51] Int. Cl.[5] ..... F26B 3/00

[52] U.S. Cl. ..... 34/13; 34/20; 34/26

[58] Field of Search ..... 34/135, 136, 137, 35, 34/85, 86, 17, 13, 20, 60, 26, 28; 209/11, 238; 241/40, 42, 52

[56] References Cited

U.S. PATENT DOCUMENTS 4,415,444 10/1983 Guptail ..... 34/20

FOREIGN PATENT DOCUMENTS 2856536 9/1983 Fed. Rep. of Germany .
3400656 7/1985 Fed. Rep. of Germany .
3110578 8/1989 Fed. Rep. of Germany .
3825361 2/1990 Fed. Rep. of Germany .
3903604 3/1990 Fed. Rep. of Germany .

*Primary Examiner*—Henry A. Bennet
*Attorney, Agent, or Firm*—Herbert Dubno

[57] ABSTRACT

Although an elevated process temperature is used for reprocessing used sands having high clay-like portions, the upper limit thereof is fixed such that chamottization of the sand and combustion of organic binder components do not occur. The air-gas mixture is circulated in a drier and a mechanical reprocessing step arranged downstream thereof and heated to process temperature by utilizing thermal energy obtained by branching off and burning part of the air-gas mixture from the circulation.

8 Claims, 2 Drawing Sheets

PROCESS FOR THE REGENERATION OF USED FOUNDRY SANDS

FIELD OF THE INVENTION

The present invention relates to a process for regenerating used foundry sands containing organic and inorganic binder components or the like, particularly containing a high portion of clay, especially bentonite.

BACKGROUND OF THE INVENTION

A process for regenerating used foundry sand is known from DE-OS 34 00 656, for example. In this known process the used sand is supplied via a magnetic separator to a rotary drum having mechanical baffles where it is dried by means of hot air passed through the drum. The drum simultaneously serves for comminuting the sand components, if necessary, and mechanically removing the binder components adhering to the sand grains by means of friction. The grinding bodies present in the rotary drum may also serve this purpose. However, this mechanical removal may also be carried out in a separate step by means of an impingement separator as known from DE-PS 28 56 536 or DE-PS 31 10 578, for example.

After temporary storage, the sand is passed through, a fluid-bed furnace in the prior art process, in which namely the chemical components, such as organic binders, are burned off at temperatures of around 800° C. The hot sand is then passed through a cooling drum where the sand is subsequently cleaned and cooled to room temperature by means of cooling air. Then, the sand can be classified and reused. Hot outlet air of the fluid-bed furnace is used to dry the sand, which air is supplied to the drying drum through, an outlet-air filter and, after renewed filtering, is discharged together with all gaseous pollutants into the atmosphere impairing the environment. The outlet air of the cooler and the air used for conveying the sand is also discharged into the atmosphere after passing the filter.

The reprocessing of the used sands in forges has become increasingly important, since a simple disposal of the used sands faces increasing difficulties for ecological reasons. Thus, regeneration plants for used sands are employed increasingly. These used sands may contain chemical additives, particularly organic binders as well as inorganic binders such as clays. The regeneration of used sands having high proportions of clay creates special difficulties. (In the case of natural sands and clay sands) the clay proportion may be present as kaolinite, as montmorillonite (main component of bentonite) and as mullite or aluminosilicate (an important component of chamotte).

A purely mechanical removal or regeneration of the used sands will only be satisfactory if they have a relatively low clay content. As in the process according to the abovementioned OS 34 00 656, frequently a thermal treatment step is introduced in which the used sands are heated to temperatures of about 800° C. At these temperatures, the organic binders are burned and the clay-containing components are baked to a considerable extent as mullite onto the quartz sand grains. The sand is chamotted in this way, the chamotte portion frequently reaching 5% or more in the regenerated sand. In this case, it proved to be disadvantageous that the chamottization results in an increased consumption of certain binder components. In addition, the sand surface becomes considerably porous, which also substantially raises the binder consumption. The combustion of the organic components also adds thereto, since additional cavities form in the quartz grain by this combustion.

Another drawback of heating the sand to elevated temperatures is represented by the high demand for thermal energy. Furthermore, the sand grains have to be subjected to another mechanical removal after this heating. These drawbacks can partially be eliminated successfully when the used sand is regenerated in a wet state. However, this leads to high costs and considerable problems with respect to the disposal of the resulting sewage sludge.

OBJECT OF THE INVENTION

It is the object of the present invention to avoid the drawbacks indicated and provide an improved dry regeneration process which results in a good quality of the regenerated sand and considerably reduced cost.

SUMMARY OF THE INVENTION

According to the invention air is supplied to the drying step at a temperature markedly below the sintering temperature of clay-containing binders and below the combustion temperature of organic binders and the air-supply temperature is limited to a maximum of 550° C., the dried sand is directly supplied to the mechanical removal step and the air-gas mixture drawn off from the drying step is again supplied to the drying step in a closed circulation through the mechanical removal step arranged directly downstream, a dry-type filter and a heater.

The regeneration process is based upon the arrangement of the above-mentioned DE-PS 31 10 578, in which the second mechanical cleaning step of the above-mentioned arrangement is replaced by a thermal cleaning step (cf. DE-OS 38 25 361). At least one mechanical regeneration step each is arranged upstream and downstream of this thermal regeneration step. In this known arrangement, the thermal regeneration step is designed such that the sand covers are heated markedly faster than the sand grains themselves, so as to create thermal stresses in the sand covers, which result in coking and embrittlement of the unregeneratable covers.

The essential point is that the physical behavior of the cover is changed for the subsequent mechanical regeneration by kind of a thermal-shock treatment of only the cover, so that the embrittled covers burst open or split off more easily. For this purpose it is necessary that the fuel-gas stream have a much more elevated temperature than required for a thermal regeneration of the sand mixture and be around 1000° C. or above. At the same time, the contact time between the sand to be regenerated and the hot gas stream is so short that the sand grains are not heated above a temperature of about 200° C. to 300° C. On the other hand, the supply temperature of the fuel-gas stream is so high that aluminum particles are immediately fused or gasified.

By contrast thereto, the process according to the present invention has a substantially different direction.

In the new process, the used sand is not heated to elevated temperatures. The residual substance obtained as dust still contains all bindable dry components and can be introduced again into the foundry process. The process temperature is limited in all steps in such a way that neither chamottization nor combustion of organic components takes place. As a result, the demand for thermal energy is considerably reduced. Above all, an increase in the pH value of the sand is avoided, and the porosity of the quartz sand surface is reduced substantially, so that a considerably lowered demand for binders results when the regenerated sand is used again. The organic binders and above all the clay-containing binders are removed mechanically in an effective manner. In this case, residues of organic binders remain in the sand pores. This results in a considerable reduction of the surface area of the sand grains, i.e. a smoother surface requiring less binder. In this case, the temperature is restricted to a maximum of 550° C.

Another advantage is that the process air or the air-gas mixture forming in the treatment are cycled through the drying step and the (first) mechanical removal step directly downstream thereof, through a dry filter arranged downstream of the regeneration step and an air heater. In this way, the process heat is largely maintained. A predetermined air-gas mixture portion is continuously branched off from the circulation and fed to a post-combustion. The post-combustion may also serve for rendering inert the excessive portions of the dust-like components separated from the sand. For ecological reasons, such a rendering inert is absolutely necessary before these components are stored in a disposal. The thermal energy, which is obtained when the branched air-gas mixture is burned and the excessive dust components are refired, is available for heating or reheating the cycled air-gas mixture. This serves for obtaining a good quality of the regenerated sand whose reuse is therefore not restricted. Furthermore, a process control is achieved which fully complies with all ecological requirements. The regenerated sand obtained in the new process also ensures more economical use of the binder. Finally, the process is also particularly favorable as to energy consumption and for reasons of costs.

The new process can even be designed in a simpler manner and modified to serve this purpose, considerable savings still being obtainable with respect to the arrangement and the process costs. It has been found, for example, that the tasks and functions which are met by the drying step can also be carried out by the first mechanical regeneration step, since due to the strong mechanical load of the sand drying takes place in this step extremely rapidly and thus, when the mechanical regeneration starts, the used sand already ready has a consistency the same as that when it is supplied.

According to the invention a predetermined portion can be continuously branched off from the circulation of the air-gas mixture and supplied to an afterburner step and that the thermal energy obtained in the afterburner step is fed to the heater. The drying can take place in a mill drying step. The excessive portions of the dust-like components separated in the mechanical removal step from the sand and/or oversized grains can also be supplied to the afterburner step for the purpose of being rendered inert.

By avoiding the drying step, the sand and the air heated to a maximum supply temperature of 550° C. are supplied directly to the mechanical removal step.

The heated air having a maximum temperature of up to 250° C. is supplied to the first mechanical removal step provided as a uni- or multi-cellular impingement separator. A second removal step operating preferably pneumatic-mechanically can be arranged directly downstream of the first pneumatic-mechanical removal step, whose process air is conducted in a separate closed circulation via a dry-type filter. The amount continuously branched off from the closed circulation of the heated gas mixture and supplied to the post-combustion can be continuously replaced from the separate closed circulation of the second mechanical removal step.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
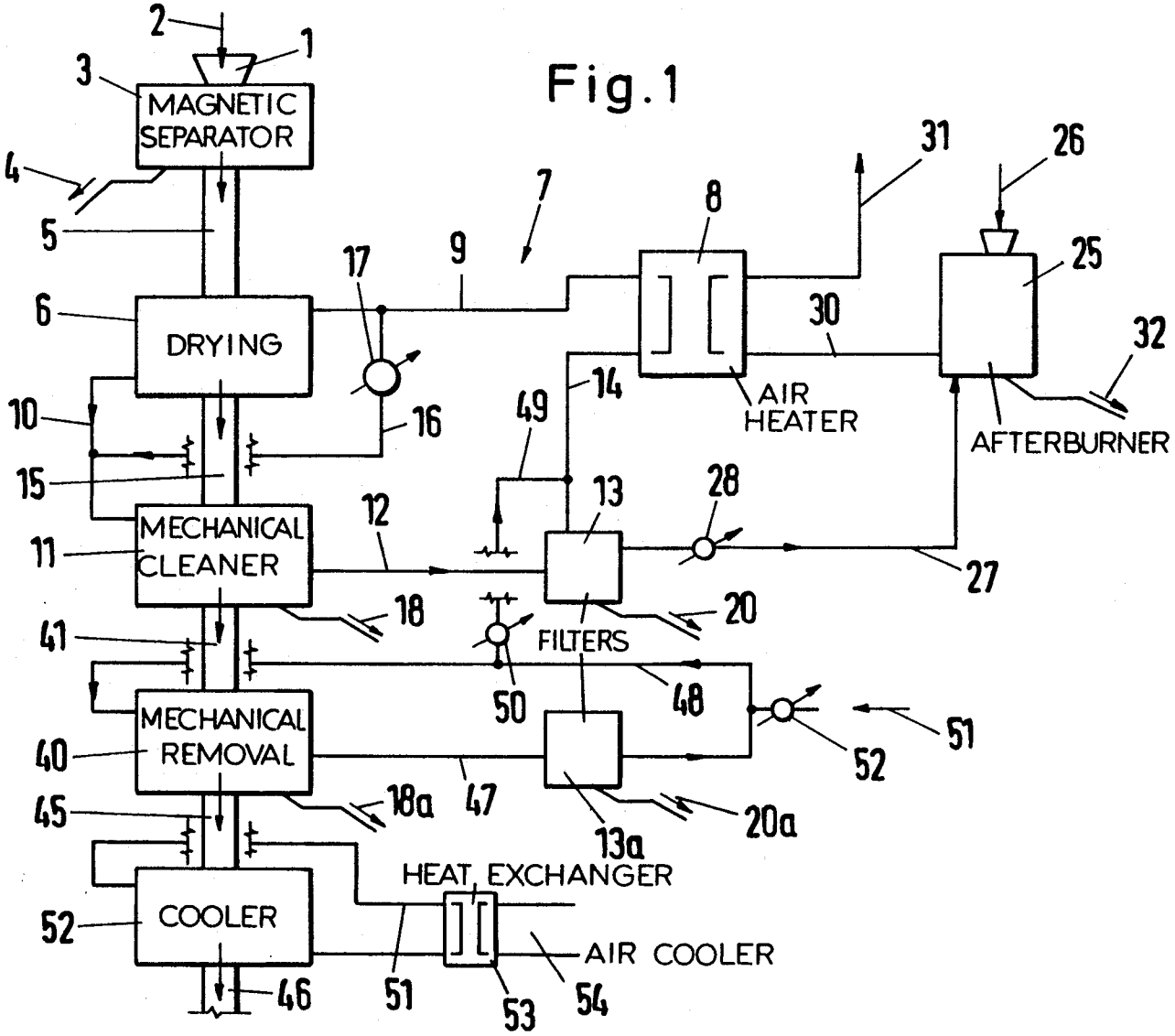
FIG. 1 is a flow diagram which shows an arrangement for carrying out the process according to the invention and FIG. 2 is a flow diagram which shows an arrangement for carrying out the process according to another embodiment.

The new regeneration process comprises several steps. The used sand, illustrated by arrow 2, is fed to a magnetic separator 3 or the like at 1 prior to the first treatment step in order to separate the cast residues and other metallic parts present in the used sand at 4. The used sand treated in this way is fed to a drying step at 6. This step usefully consists of a mill drying means in which the sand passed through is kept in motion, sand agglomerations are comminuted and the sand is dried by means of hot air. The used sand fed at 5 can have a residual moisture of 2 to 3%. This moisture is removed in the mill drying means as completely as possible. The movement of the sand in the mill drying means can be effected by material-agitating elements or the like. Various suitable mill drying means are known, so that it is not necessary to describe them in detail.

The drying air added to the arrangement is conducted in a circulation system 7. The air is heated in an air heater 8 and supplied to the drying means 6 at 9. The temperature of the drying air is adjusted to a maximum of 500° to 550° C. The used sand is heated, comminuted and dried in the mill drying means. The temperature of the used sand may be about 120° C. when it leaves the drying means 6. The outlet air leaves the drying means at 10 at about the same temperature and is passed into a first mechanical cleaning or regeneration arrangement 11 which is arranged directly downstream thereof. In step 11, a uni- or multi-cellular impingement introduction hereof. The carrier medium for introductory part of the description. The carrier medium for the sand which is required for this purpose is supplied through line 10 of step 11. The carrier medium consists of the air-gas mixture forming in the drying zone 6. The carrier medium is also preferably adjusted to a maximum elevated temperature of up to 250° C. For adjusting the temperature, heated air may be branched off from line 9 through valve 17 and line 16 and admixed to the air-gas mixture in line 10. The air-gas mixture drawn off from step 11 is supplied through line 12 to a dry-type filter 13 from where it is passed back to the heater 8 through line 14, from which the air-gas mixture is again supplied to the process.

Figure 2:
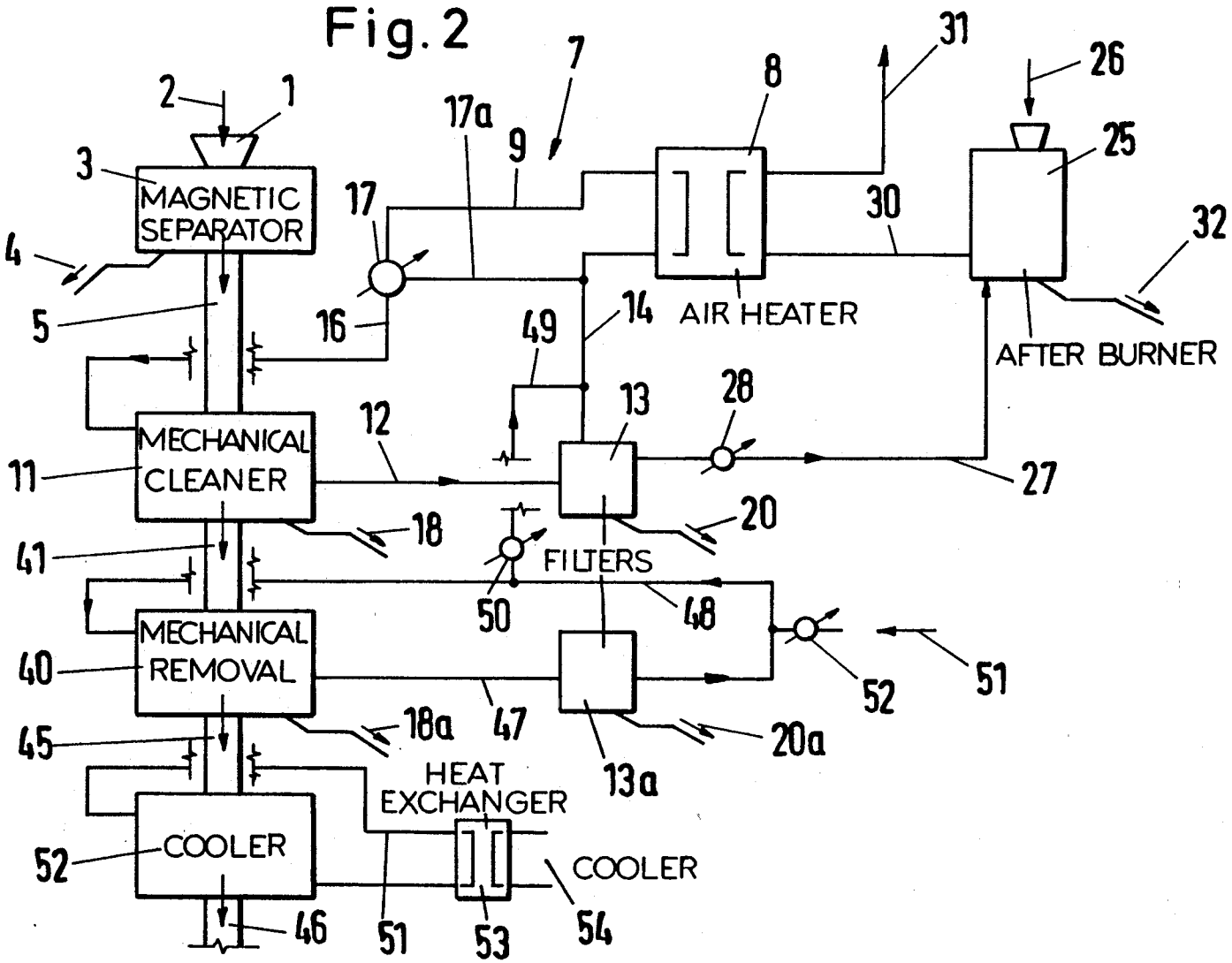

The drying stage 6 is omitted in the embodiment of FIG. 2.

The oversized grains resulting in the mechanical removal in step 11 are removed at 18. Dust-like components are delivered to the filter 13 by the air-gas mixture through line 12 and removed from the circulation at 20.

An air-gas mixture portion from the circulation 7 which is adjustable via valve 28 is continuously branched off via line 27 and burned in the afterburner 25. Those excessive portions of the dust-like components that are discharged from the filter at 20 are also fed to the afterburner 25 at 26. These components are converted into an inert state by the combustion process, so that they can be discharged at 32 and stored in a disposal in an ecologically safe manner. The thermal energy obtained in the afterburner 25 is supplied to a heat exchanger via the exhaust gases according to line 30 and optionally to an additional source of heat in the heater 8. After the emission of heat, the exhaust gases can be supplied to the chimney at 31, optionally after corresponding purification. The air-gas mixture portion discharged at 27 can be replaced by fresh air supplied to the circulation 7.

The thus reprocessed sand can now be cooled directly and supplied to reuse.

However, it is useful to arrange a second mechanical removal step 40 downstream, to which a separate air circulation 47, 48 is assigned which has a corresponding filter arrangement 13*a* for separating the dust-like components at 20*a*. The mechanical removal arrangement 40 can be developed in a way corresponding to that of the removal arrangement 11. Here, too, remaining oversized parts can be discharged at 18*a*.

When a second cleaning arrangement is disposed downstream, the necessary supplementary air can be supplied to the first air-gas circulation via valve 50 and line 49 from the second circulation 47, 48, which in turn is supplied with supplementary air via valve 52 at 51.

The sand reprocessed in step 11 enters the second mechanical treatment step 40 with a residual heat of e.g. 120° to 200° C. In this step, this access temperature of the sand determines the process temperature. In this step, the sand cools down to e.g. 100° C. and enters the downstream cooler 52 at 45 with this temperature. An independent cooling circulation, e.g. a water cooling circulation 51, serves for further cooling the sand, from which the heat is withdrawn via the heat exchanger 53 and e.g. an air cooler 54.

The fine portions accumulating and separated from the filter arrangements at 20 or 20*a* still contain active components of bentonite and carbon brighteners. These dust-like components can therefore be reused to a considerably extent in the reprocessing of green sand. The excessive dust-like components, however, are supplied to the combustion at 26 as mentioned above.

For example, the amount of air required in the first circulation may be 7000 $Nm^3/h$ when the arrangement has an output of 5 t/h. The amount branched off through line 27 is about 50 $Nm^3/h$. The temperature in the mill dryer 6 is preferably between 120° and 500° C., whereas it is useful to keep the process temperature below 250° C. in step 11. The residence time of the sand is about 1 hour in the drier 6 and about ½ to 1 hour in each of the removal steps 11 and 40. When pneumatic-mechanical regeneration steps, e.g. impingement separators, are used in steps 11 and 40, the rate of the carrier medium is between 20 and 40 m/s.

The above-mentioned values relate to a specific arrangement. The values depend on the respective circumstances and the output of the arrangement.

The heater 8 usefully consists of a heat exchanger arranged downstream of the afterburner 25 and a connectable heating means.

The arrangement according to FIG. 2 only differs from that according to FIG. 1 by the area between the magnetic separator 3 and the first mechanical purification or regeneration arrangement 11, which in this embodiment is arranged directly downstream of the magnetic separator 3. The heated air of the hot gas circulation 7 is directly supplied to the first mechanical regeneration step 11 and as usual is again supplied to the closed circulation system 7 through line 12. For example, by admixing part of the cooler gas mixture from the line section 14 through the by-pass line 17*a*, the supply temperature of the gas mixture can be adjusted to the desired value in line 16 via valve 17. This supply temperature always has a maximum of 550° C. However, the temperature of the gas mixture supplied to the first mechanical removal step is preferably adjusted to a value not exceeding 250° C.

A comparison with FIG. 1 shows that the arrangement according to FIG. 2 is simplified and can be designed in an even more economical and energy-saving manner. In this process, too, the binder components still have very high binding power, so that they can be reused directly for reprocessing the regenerated sands used for mold production.

I claim:

1. A process for dry regeneration of a used foundry sand having a high proportion of organic and inorganic binder including clay associated therewith, comprising the steps of:

(a) separating metal residues from a used foundry sand having a high proportion of organic and inorganic binder including clay associated therewith;

(b) following step (a) mechanically cleaning the used foundry sand having a high proportion of organic and inorganic binder including clay associated therewith from which metal residues have been separated in the presence of heated air at a temperature of a maximum of 550° C. and substantially below a sintering temperature of the inorganic binder and below a combustion temperature of the organic binder, to remove solid impurities from the sand;

(c) recovering an air/gas mixture from step (b);

(d) dry filtering the air/gas mixture recovered in step (c);

(e) heating the dry filtered mixture from step (d);

(f) recycling said mixture heated in step (e) to step (b) in a closed recirculation path;

(g) cooling the sand from which impurities are removed in step (b); and (h) throughout regeneration of said used sand, maintaining a temperature thereof below any sintering temperature of the inorganic binder and below a combustion temperature of the organic binder to limit increase in porosity of said sand and chamottization of said inorganic binder.

2. The process defined in claim 1 wherein, following step (a) and prior to step (b), said used foundry sand having a high proportion of organic and inorganic binder including clay associated therewith and from which metal residues has been separated is dried in the presence of the heated air at a temperature of a maximum of 550° C. and substantially below the sintering temperature of the inorganic binder and the combustion temperature of the organic binder, before being fed to the mechanical cleaning of step (b) where it is further contacted with the heated air, the recycled mixture from step (e) being at least in part fed directly with heated air to the drying prior to mechanical cleaning.

3. The process defined in claim 1 or claim 2 wherein a predetermined portion of said mixture is continuously branched off from said circulation and supplied to an afterburner, heat from said afterburner being used to heat air contacted with said used foundry sand.

4. The process defined in claim 1 or claim 2 wherein drying of said used foundry sand is effected in a mill drying stage.

5. The process defined in claim 1 or claim 2 wherein dust components are separated with said impurities from the sand in step (b) and are fed to an afterburner and thereby rendered inert.

6. The process defined in claim 1 or claim 2 wherein heated air at a temperature of at most 250° C. is supplied to the mechanical cleaning in step (b) formed as an impingement separator stage.

7. The process defined in claim 1 or claim 2 wherein a mechanical removal stage operating pneumatic-mechanically is disposed downstream of the mechanical cleaning of step (b) and is supplied with process air through a separating closed circulation via a dry filter.

8. The process defined in claim 7 wherein a portion of said mixture is continuously branched from the closed recirculation path and is replaced by gas from said separating closed circulation.

* * * * *